US008292645B2

(12) United States Patent
Cairns

(10) Patent No.: US 8,292,645 B2
(45) Date of Patent: Oct. 23, 2012

(54) KEYLESS HARSH ENVIRONMENT CONNECTOR

(75) Inventor: James L. Cairns, Ormond Beach, FL (US)

(73) Assignee: Teledyne Instruments, Inc., Thousand Oaks, CA (US)

( * ) Notice: Subject to any disclaimer, the term of this patent is extended or adjusted under 35 U.S.C. 154(b) by 146 days.

(21) Appl. No.: 12/943,301

(22) Filed: Nov. 10, 2010

(65) Prior Publication Data

US 2011/0130024 A1 Jun. 2, 2011

Related U.S. Application Data

(60) Provisional application No. 61/260,100, filed on Nov. 11, 2009.

(51) Int. Cl.
*H01R 13/52* (2006.01)

(52) U.S. Cl. ..... 439/271

(58) Field of Classification Search ..... 439/199, 439/201, 205–206, 271, 273, 276, 587, 604
See application file for complete search history.

(56) References Cited

U.S. PATENT DOCUMENTS

| | | | | |
|---|---|---|---|---|
| 3,508,188 | A | 4/1970 | Buck | |
| 3,643,207 | A | 2/1972 | Cairns | |
| 3,729,699 | A | 4/1973 | Briggs et al. | |
| 4,373,767 | A * | 2/1983 | Cairns | 439/275 |
| 4,390,229 | A | 6/1983 | Chevalier | |
| 4,606,603 | A | 8/1986 | Cairns | |
| 4,909,751 | A | 3/1990 | Marolda | |
| 4,948,377 | A | 8/1990 | Cairns | |
| 5,171,158 | A | 12/1992 | Cairns | |
| 5,267,880 | A | 12/1993 | Tamm | |
| 5,334,032 | A | 8/1994 | Myers et al. | |
| 5,484,296 | A | 1/1996 | Taylor | |
| 5,722,842 | A | 3/1998 | Cairns | |
| 5,772,457 | A * | 6/1998 | Cairns | 439/201 |
| 5,899,765 | A * | 5/1999 | Niekrasz et al. | 439/201 |
| 6,017,227 | A | 1/2000 | Cairns et al. | |
| 6,315,461 | B1 * | 11/2001 | Cairns | 385/56 |
| 6,464,405 | B2 * | 10/2002 | Cairns et al. | 385/56 |
| 6,736,545 | B2 * | 5/2004 | Cairns et al. | 385/56 |
| 7,364,448 | B2 * | 4/2008 | Cairns et al. | 439/201 |
| 7,429,193 | B2 * | 9/2008 | Cairns et al. | 439/578 |
| 7,462,054 | B2 * | 12/2008 | Cairns et al. | 439/271 |
| 7,794,254 | B2 * | 9/2010 | Marklove et al. | 439/271 |
| 8,025,506 | B2 * | 9/2011 | Cairns | 439/24 |
| 2006/0246760 | A1 * | 11/2006 | Ogle et al. | 439/271 |

OTHER PUBLICATIONS

U.S. Appl. No. 13/030,698, filed Feb. 18, 2011.
U.S. Appl. No. 13/009,681, filed Jan. 19, 2011.
Notification, International Search Report and Written Opinion dated Jun. 28, 2011 from PCT/US2010/056241.

* cited by examiner

*Primary Examiner* — Vanessa Girardi
(74) *Attorney, Agent, or Firm* — Procopio, Cory, Hargreaves & Savitch LLP

(57) ABSTRACT

A keyless harsh environment connector has a plug unit containing a pin having an outer surface carrying a plurality of axially spaced, annular contacts of gradually decreasing diameter towards a forward end of the pin, and a receptacle unit having a fluid-filled chamber containing a corresponding number of axially spaced, annular contacts of gradually increasing diameter towards a forward end of the receptacle unit, configured for mating engagement with corresponding contacts on the plug pin when the units are mated. A sealing mechanism at a forward end of the chamber seals the chamber when the units are unmated and forms a seal with the plug pin on mating of the units. The plug pin is hollow and extends through an interface between opposing seals at the front end of the receptacle contact chamber during mating.

56 Claims, 5 Drawing Sheets

KEYLESS HARSH ENVIRONMENT CONNECTOR

RELATED APPLICATION

The present application claims the benefit of U.S. provisional pat. App. Ser. No. 61/260,100, filed Nov. 11, 2009, the contents of which are incorporated herein by reference in their entirety.

BACKGROUND

1. Field of the Invention

The present invention relates generally to connectors which can be mated and unmated in a harsh environment, such as underwater, and is particularly concerned with a harsh environment electrical or hybrid connector.

2. Related Art

Since about the early 1960's, connectors that could be mated and de-mated in harsh environments, particularly underwater, have been commercially available. The earliest of these was a rubber-bodied pin-and-socket connector that embodied one or more ring-like contacts molded into a cylindrical rubber pin, and respective one-or-more ring-like contacts molded into a rubber bore. These connectors have the advantage that the two mating halves require no particular rotational alignment. For that reason, they are said to be keyless.

These connectors are relatively inexpensive, but not reliable enough for most critical applications. They have the distinct disadvantage that they cannot be unmated underwater except at very modest depths; and, in models having more than one set of contacts arranged along the pin and bore, cross-connection briefly takes place as un-matched pin and socket contacts slide past each other during mating and de-mating. Cross-connecting circuits can sometimes be disastrous for the electronics to which they are attached. In spite of these shortcomings, these connectors are still widely used today.

In the early 1970's a more dependable sort of harsh-environment connector was introduced (U.S. Pat. No. 3,643,207). The plug portion consisted of multiple pins with electrically insulated shafts and conductive tips. The receptacle had corresponding socket contacts in an oil-filled chamber. The chamber's internal pressure was balanced to that of the outside environment by way of a flexible wall. The male and female electrical junctions made contact within the electrically insulating oil, completely isolated from the outside environment. One example of this type of oil-filled connector is described in U.S. Pat. No. 3,643,207 of Cairns.

These oil-filled connectors were remarkably more reliable than the earlier rubber-molded ones. They were also more expensive. They were not accepted commercially for two main reasons: In those days they were untried technology, and, because of the multiple pins, they required rotational alignment. When multiple-pin connectors are mated, three orientation elements must be controlled: axial tilt, axial offset, and rotational alignment. The last of these is generally the most difficult to manage.

The offshore oil and gas industry is one of the principal markets for underwater mateable connectors. Many of the connectors used for that industry's subsea operations are connected and disconnected remotely, either by being mounted to large, opposed plates (stab plates) that come together during the mating process to join arrays of connectors, hydraulic couplers, and the like, or by the manipulators of remotely operated vehicles (ROV's). Mating remotely is made more difficult and expensive by the requirement to control the rotational alignment of the individual components to be mated.

In the early 1980's two-contact fluid-filled electrical connectors that required no rotational alignment were made commercially available. One example of such a connector is described in U.S. Pat. No. 4,606,603 of Cairns. These connectors did not immediately overcome customer reluctance to accept oil-filled technology, but they did solve the rotational alignment problem. They quickly became the offshore industry's standard for high-reliability operations, and remained so for the next decade.

The plug of the two-contact, fluid-filled connector consisted of one elongated, insulated pin that housed two coaxially disposed contacts. The corresponding receptacle contacts were contained in a flexible-walled, fluid-filled chamber. The chamber had a circular, elastic, penetrable opening in the anterior end that, in the unmated condition, was squeezed tightly shut by a rubber sphincter. The connectors had some problems. One problem was that two contacts were not enough to satisfy the needs of most operations. Another problem was that the receptacle's circular end-opening, which had to be pinched tightly closed before and after mating, had to be stretched several hundred percent to receive the plug's pin. If mated for a long time, particularly at low ocean temperatures, the opening did not close upon de-mating, and the connector subsequently failed.

As time went on more contacts, as many as six, were staged on to a conical portion of the plug's tip, and likewise their counterparts were added to the receptacle. Because of spatial constraints, this arrangement unacceptably diminished the connector's reliability. Modern specifications for connectors of the fluid-filled type require at least one, and preferably two, sealed insulating barriers, usually rubber, between each set of mated pin/socket contacts and every other set; and furthermore, between each set and the outside environment. The redundant barriers are a precaution in case of a single-seal failure. Although the two-contact version of the above keyless coaxial connector did have one seal between contact sets in the mated condition, the six-contact version had none. It was not possible to increase the plug pin's diameter further to make space for seals. Because the receptacle's penetrable opening had to close tightly when unmated, its at-rest size had to be small; and could not be increased. It was already stretched beyond acceptable limits when mated, so there was no way to up-size the pin.

In the late 1980's, multiple pin, fluid-filled connectors were once again introduced. They have all the required barriers, are robust, and exceptionally reliable. One such connector is the subject of U.S. Pat. No. 4,948,377 of Cairns. These connectors are manufactured by Teledyne ODI. They replaced the two-contact, single pin fluid-filled connectors described above as the high-reliability standard for the offshore industry. These connectors still have the rotational alignment problem, however, which somewhat limits their use, and require special keying provisions for rotational alignment.

In the early 1990's a keyless, coaxial, oil-filled, wet-mateable connector was introduced that required no rotational alignment. This connector is described in U.S. Pat. No. 5,171,158 of Cairns (hereinafter '158 patent). It consisted of multiple ring-like contacts spaced along a constant diameter portion of the plug pin. The receptacle had corresponding ring-like contacts spaced along a rubber bore to receive the plug contacts. The overall layout of the contacts was very similar to the first type of connector described above. The main differences were that the connector of the '158 patent housed the receptacle contacts in a pressure-balanced, fluid-filled chamber; and, when mated, the individual pin/socket pairs were separated from each other by a single rubber seal. Unlike the coaxial connector of U.S. Pat. No. 4,606,603 (hereinafter '603 patent), the anterior sealed opening through which the plug's probe passed when entering the receptacle's chamber was occupied by a spring loaded piston before and after mating. That removed the necessity of the sealed opening to be pinched closed to a zero diameter as in the '603 patent.

The connector shown in the '158 patent was reasonably successful technically and quickly gained a dedicated customer base, but it was discontinued after being on the market for just a couple of years. It proved to be too expensive and difficult to manufacture. It also still had the problem of cross-connection during mating and de-mating as the plug's contacts wiped across receptacle contacts which were not their intended counterparts.

The need for a keyless, reliable, wet-mateable connector still remains unfulfilled.

SUMMARY

Embodiments described herein provide a new keyless or harsh environment connector suitable for electrical or hybrid applications.

In one embodiment, a keyless submersible or harsh environment connector is provided which comprises a plug unit containing a pin having an outer surface carrying a plurality of axially spaced, annular contacts of gradually decreasing diameter towards a forward end of the pin, and a receptacle unit having a fluid-filled chamber containing a corresponding number of axially spaced, annular contacts of gradually increasing diameter towards a forward end of the receptacle unit, with a sealing mechanism at a forward end of the chamber which seals the chamber when the units are unmated and forms a seal with the plug unit probe or pin both during and after mating of the units.

In one embodiment, the sealing mechanism may comprising a spring-loaded stopper which is biased into an opening in the forward end of the chamber surrounded by an outer seal member which seals against the stopper in the unmated condition. As the plug pin enters the chamber, it pushes the stopper back and the outer seal member seals against the outer surface of the pin.

In another embodiment, the plug pin is hollow, and the forward end of the receptacle unit comprises an annular end seal. A centering rod extends through the chamber and has a forward end portion having an inner seal which is in sealing engagement with the outer seal in the forward end of the chamber in the unmated condition. When the hollow plug pin enters the receptacle unit, it presses against the interface between the two seals, eventually passing between the seals and into the chamber. In the mated condition, the opposing outer and inner seals seal against opposing outer and inner surfaces of the hollow plug pin. In one embodiment, garter springs embedded in the outer seal at the forward open end of the chamber close the outer seal against the opposing inner seal on the centering rod when unmated, and against the opposing outer surface of the plug pin when the units are mated.

Dual sealing barriers may be provided between all of mating contacts on the pin and receptacle module pairs. In one embodiment, an elastomeric bladder surrounds the receptacle contact chamber and the bladder has spaced annular ribs between each pair of contacts which engage the outer surface of the hollow plug pin in the mated condition to form the dual sealing barrier. The sealing mechanism at the forward end of the chamber may also comprise a dual seal arrangement.

This arrangement provides a keyless multiple contact connector which does not require rotational alignment. In one embodiment, the connector has dual sealing barriers between all contact pairs and a dual sealing barrier to the outside environment. The keyless connector does not require the penetrable opening of the receptacle to squeeze down to a zero diameter, and does not result in cross-connections when mating and de-mating due to the stepped diameter of the contacts. The connector is not fundamentally limited in the number or size of the electrical contacts, does not require un-acceptable stretch of the elastomers, and is virtually interchangeable with the present industry-standard connectors. The connector is extremely simple and does not require complex manufacturing technology.

Although a keyless electrical connector is described above, it may form part of a hybrid electro-optical connector in other embodiments.

The hollow pin version of the keyless connector is a viable, lower-cost, more versatile product than the present spring-and-stopper industry standard, which has the disadvantage that the front portion of any electrical pin is partially exposed to seawater in the fully mated condition, potentially increasing electrical stress, and also resulting in degradation of exposed parts of the pin due to extended exposure to seawater.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for a harsh environment connector for simultaneously joining two or more electrical circuits. The connector has mateable plug and receptacle units with at least one pin on the plug entering a contact chamber in the receptacle on mating. The pin has a plurality of annular contacts in progressively larger diameters in a direction away from the tip of the pin, while the receptacle portion has annular contacts on an inner surface staged in matching, progressively smaller diameters from the forward or entry end of the receptacle unit.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention.

Although the connector is electrical only in the embodiments described below, it may also be a hybrid electro-optical connector including optical circuits.

Figure 1:
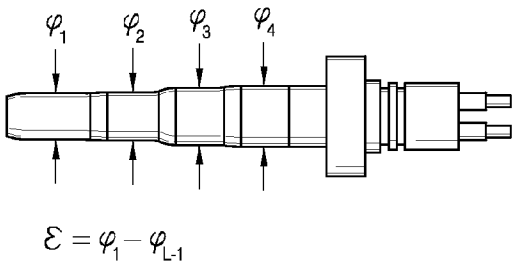
FIG. 1 is a side-elevation view of the pin of a plug unit of one embodiment of a keyless pin and socket connector.

As stated previously, one of the problems of existing-art keyless connectors is circuit cross-connection during mating and demating. One embodiment of a plug unit of a keyless connector for solving that problem is illustrated in FIG. 1. In this case, the problem is solved by a pin-and-socket connector in which the plug portion has a plug module with annular contacts staged in progressively larger diameters along a pin from tip to base, as illustrated in FIG. 1. The connector's receptacle portion (not illustrated) has respective annular contacts staged in progressively smaller diameters inward from the mating face along an internal bore. As illustrated in FIG. 1, each successive plug contact has an outer diameter $\phi$ larger than that of its predecessor. It is not necessary that the progressive diameter steps be equal, but for ease of discussion, let it be presumed that they are equal, and that the diameter step size between successive contacts is $\epsilon$, where $\epsilon=\phi_i-\phi_{i-1}$.

The same comments apply equally to the staging of receptacle contacts, whose inner diameters must be sized to fit to their respective plug counterparts. Thus the diameter difference between successive contacts in the receptacle would also be $\epsilon$.

The value for $\epsilon$ is chosen such that, during mating and demating, each plug contact can only touch its respective receptacle contact, and no other. The value of $\epsilon$ depends on how well the plug and receptacle portions of the connector are axially aligned. Clearly, the more the plug and receptacle axes are tilted or offset with respect to each other, the larger the value of $\epsilon$. In the following embodiment, with these considerations in mind, $\epsilon$ is set at 0.05 inches.

If such a connector has N contacts, there must be at least N−1 steps along the axis, one between each successive contact pair. The resulting diameter increase due to the steps is:

$$\Delta\phi=(N-1)\epsilon,$$

In the case of the four-contact connector of FIG. 1, setting $\epsilon=0.05$, gives:

$$\Delta\phi=0.15''.$$

This value of $\Delta\phi$ must be added to the outer diameter of the smallest contact $\phi$ to arrive at the largest outer diameter of the plug pin (i.e., the largest diameter contact). For mechanical strength, the center conductor diameter or outer diameter of the smallest contact should be no less than 0.10 inches, so that the outer diameter of the largest contact would be $0.10+\Delta\phi$, or in this case, 0.25 inches. Keeping this value in mind, the challenge of sealing such a connector during operations is discussed below.

The proven, reliable, spring and socket construction described in U.S. Pat. Nos. 4,948,377 and 5,171,158 referenced above does not work well for a connector whose contacts are stepped at increasing diameters. If a spring and stopper construction were used, the stopper would have to be sized to the plug pin's smallest diameter, in this hypothetical case, that of the center conductor or smallest contact, $\phi_1$. The receptacle end seal surrounding the stopper would then have to be at least a little bit smaller in order to seal to the stopper in the unmated condition. The circumferential stretch on the end seal opening is critical, and should not exceed about 25% for any substantial length of time; otherwise the seal will take a permanent large-diameter set, and will not seal to the stopper when de-mated. Since circumference and diameter are related by a constant factor of $\pi$, the end seal circumferential stretch can be written in terms of diameter as:

$$\text{Stretch } S\ (\%)=[(\Delta\phi)/(\phi_1)]100,$$

where:

S is the end seal stretch in percent $\Delta\phi$ is the difference between the large diameter of the pin occupying the end seal in the mated condition and the pin's smallest diameter $\phi_1$ is the approximate stopper diameter occupying the end seal in the unmated condition.

The initial, slight, un-mated stretch of the end seal by the stopper is ignored for convenience; but if included, it would only make matters worse. Substituting the proposed values of $\Delta\phi=0.15$ and $\phi_1=0.10$ the above equation yields a calculated stretch S=150%. That is unacceptably large.

The reasonable criterion of no more than 25% stretch could be achieved by increasing the center conductor's (and hence the stopper's) diameter. Suppose we solve for the minimum value of $\phi$1 in terms of 25% stretch, as follows:

$$S\ (\%)=[(\Delta\phi)/(\phi_1)]\times100=25,$$

Substituting our value of $\Delta\phi=0.15$, and solving for $\phi_1$ gives $$\phi_1=\mathbf{0.60''}.$$

Requiring a maximum stretch of 25% would result in a plug pin whose largest outer diameter ($\phi_1+\Delta\phi$) is 0.75 inches.

It would certainly be possible to build a reliable, functioning, connector of spring-and-stopper construction with a pin of 0.75 inches diameter; but it would not be very convenient. The oil-filled receptacle portion the connector would need to have a flexible volume large enough to accommodate the incoming plug pin during mating, as well as to accommodate thermal and pressure changes when deployed; and, to have a surplus to replace any oil losses during operation. Additionally, the receptacle's length would need to be great enough to accommodate not only the incoming pin, which is relatively long due to the axially spaced contacts; but also accommodate the stopper, whose length would likely be comparable to that of the incoming pin, and the spring, whose solid height would at least be about ⅓ that of the pin. The resulting receptacle would be awkwardly large. Thus, a spring-and-stopper construction may not be very practical for a connector with stepped-diameter contacts.

FIGS. 2 to 6 illustrate a second embodiment of a keyless pin and socket connector which uses a different sealing solution in a connector with annular contacts of progressively stepped diameters, to produce a more practical connector with stepped diameter contacts.

Figure 2:
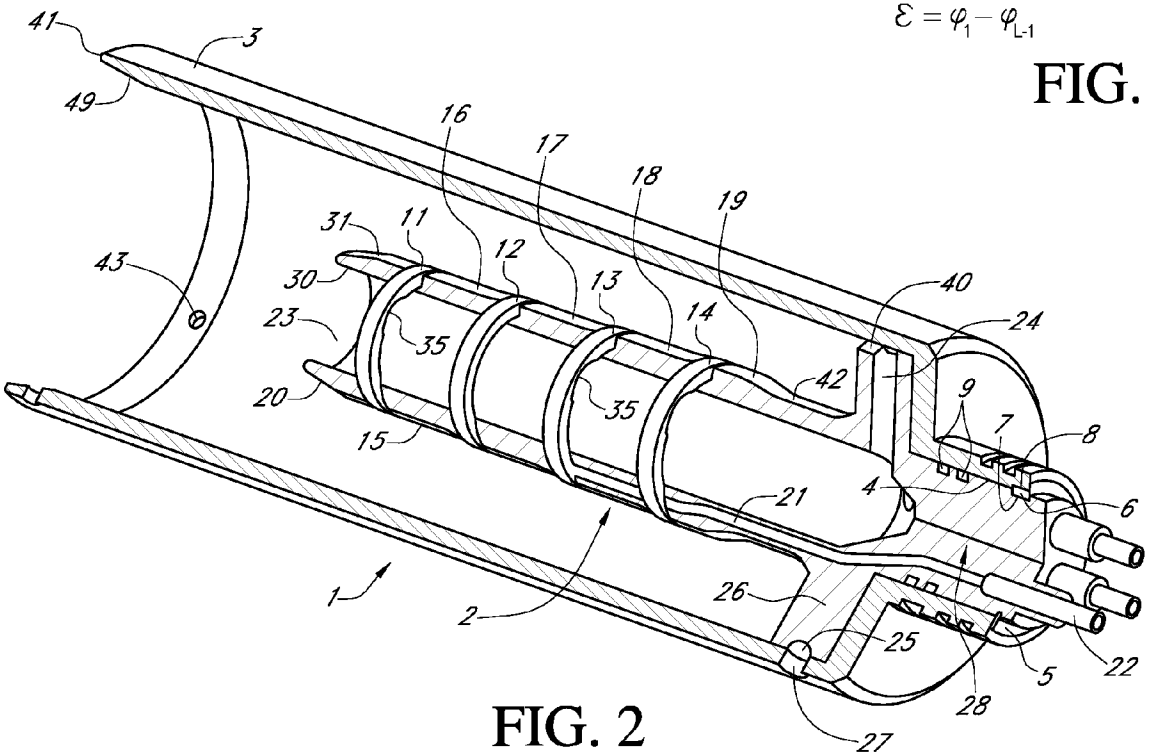
FIG. 2 is a 135 degree axial, partial cross-sectional view of a plug unit of a second embodiment of a keyless connector.

Oil-filled receptacle sizes, and hence connector sizes, are driven largely by the volume of the plug pin(s) to be inserted during operation. Stepped contacts necessarily result in relatively long, large-diameter pins, as has just been demonstrated. The pin-volume problem can be greatly diminished, however, by making the plug pin hollow; and thus, decreasing its volume, as illustrated in the embodiment of FIG. 2. There is another great advantage to hollow-pin construction; it removes the need for axial springs and stoppers, thereby greatly simplifying the resulting connectors, and dramatically reducing their length, as discussed in more detail below.

Figure 5:
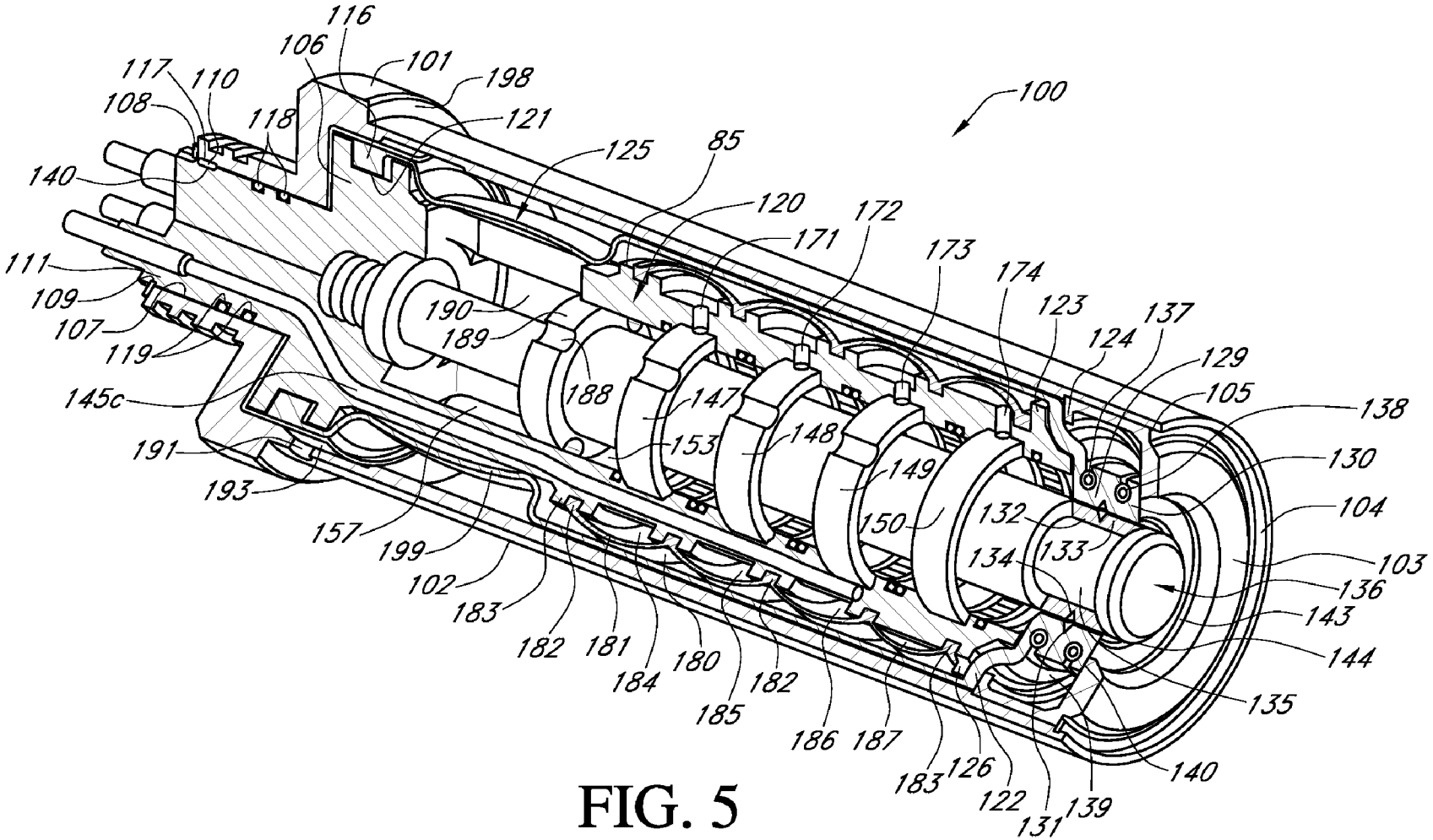
FIG. 5 is a 135 degree axial, partial cross-sectional view illustrating the receptacle contact module of FIGS. 3 and 4 mounted in a contact chamber of the receptacle unit of the keyless connector.

FIG. 2 illustrates a second embodiment of a connector plug unit 1 displayed in 135° axial, partial cross-sectional view, while FIG. 5 illustrates the corresponding receptacle unit 100 designed for mating engagement with plug unit 1 and FIGS.

3 to 4B illustrate the receptacle module 120 of unit 100 in more detail. Plug unit 1 has a contact or plug pin module 2 seated in bore 4 of outer shell 3, and axially retained in place by snap-ring 5. Retainer key 6 cooperates with keyway 7 in contact module 2 and keyway 8 in outer shell 3 to rotationally lock contact module 2 to plug shell 3. Retainer key 6 seats in the groove formed by keyways 7 and 8, and is held in place by snap-ring 5. O-rings 9 seal contact module 2 to bore 4 of outer shell 3. Outer shell 3 has an open forward end 41 having an inner taper or tapered portion 49 with vent holes 43.

Plug contact module 2 has a base 28 secured in the rear end of outer shell 3 which has a larger diameter flange 26, and a hollow contact pin 15 with inner and outer surfaces 30, 31 which projects forward from flange 26. The outer surface of pin 15 has stepped portions 16, 17, 18, 19 of progressively increasing diameter in a direction away from the open forward end of the shell 3. Four annular or ring-like electrical contacts 11, 12, 13, 14 of correspondingly increasing diameter are mounted in annular seats on successive stepped portions 16, 17, 18, 19, respectively. The contacts and pin are integrally molded with rigid, non-electrically-conductive material into a forward-projecting, generally cylindrical monolithic unit with a tapered tip 20 at the forward end of the pin. Plug or contact pin 15 is hollow along at least the majority of its length and has a bore 23 extending from open forward end into base 28.

Four conductors or conductor rods 21 (one of which is seen in FIG. 2) extend from respective contacts 11, 12, 13, 14 to respective solder cups or cable lead connectors 22 at the cable termination end or rear end of the plug unit. Contact 14 and its assembled conductor rod 21 are left un-sectioned for clarity in FIG. 2. Contacts 11, 12, 13, 14 form separate circuits with respective conductor rods 21 and respective solder cups 22 within the molded contact assembly, with each circuit comprising a contact band, a solder cup, and a respective conductor rod extending from the contact band to the solder cup. Notches 35 on the inner diameters of contacts 11, 12, 13, 14 permit clearance between the contacts and conductor rods 21 of neighboring contacts, and each clearance is filled with dielectric material during the over-molding process. Prior to over-molding, the conductors or conductor rods 21 are coated with a very thin, resilient, non-electrically-conductive material (not shown). In the post-mold shrinkage the over-molded material squeezes tightly around the thin resilient coating, thereby forming a hermetic seal to conductors 21.

Bore 23 extends inward from the open forward end of plug contact module 2 to a point in the plug contact module's base. Radial passages 24 in flange 26 ventilate bore 23 to groove 25 that runs around the circumference of the flange. Ports 27 in plug shell 3 vent groove 25 to the outside environment. Notches 40 in the outer circumference of flange 26 provide communication between vent groove 25 and the interior of plug shell 3 for escape of water during mating, as described in more detail below.

Figure 3:
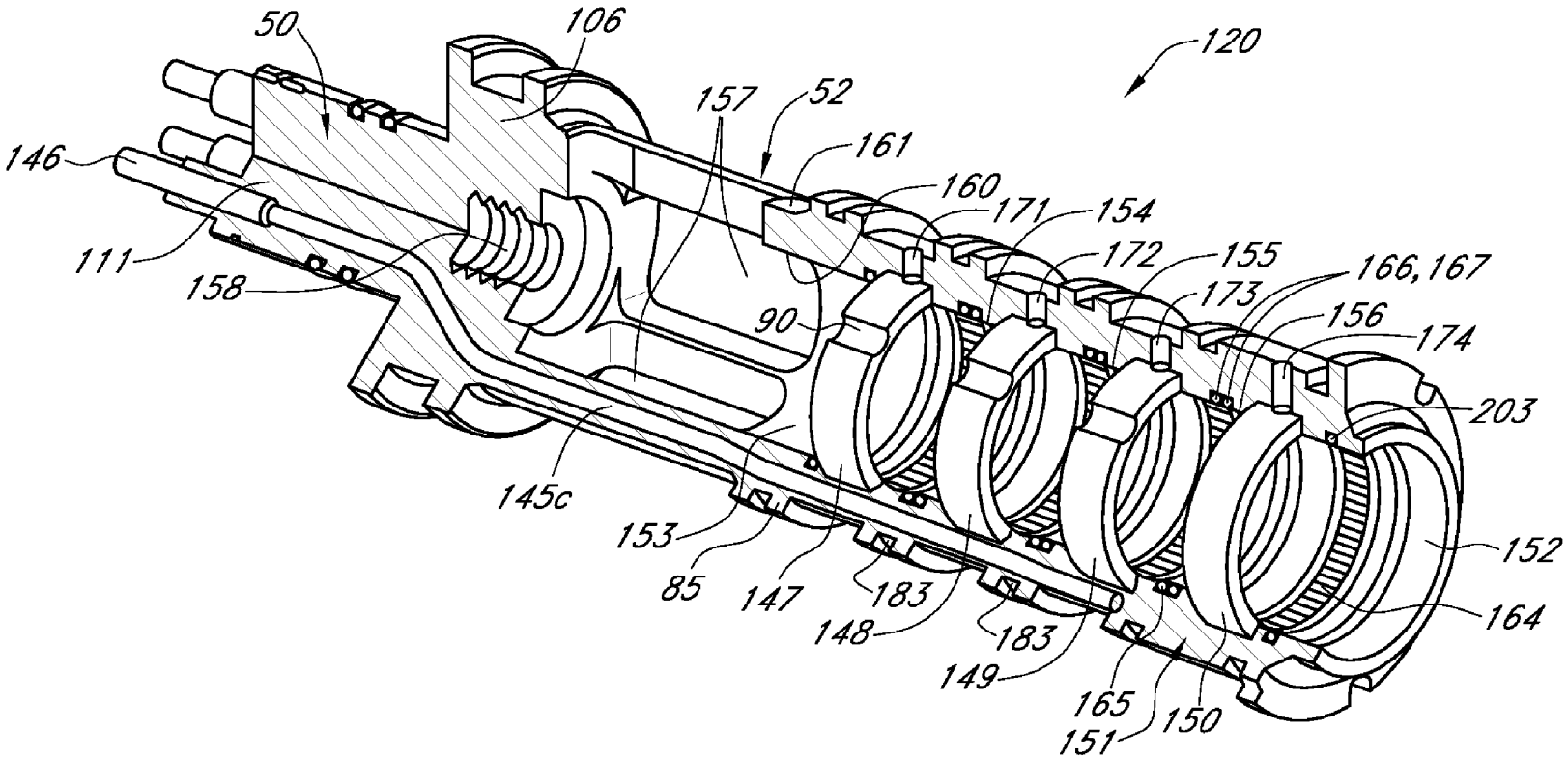
FIG. 3 is a 135 degree axial, partial cross-sectional view of a receptacle contact module of the second embodiment of the keyless connector.
Figure 4:
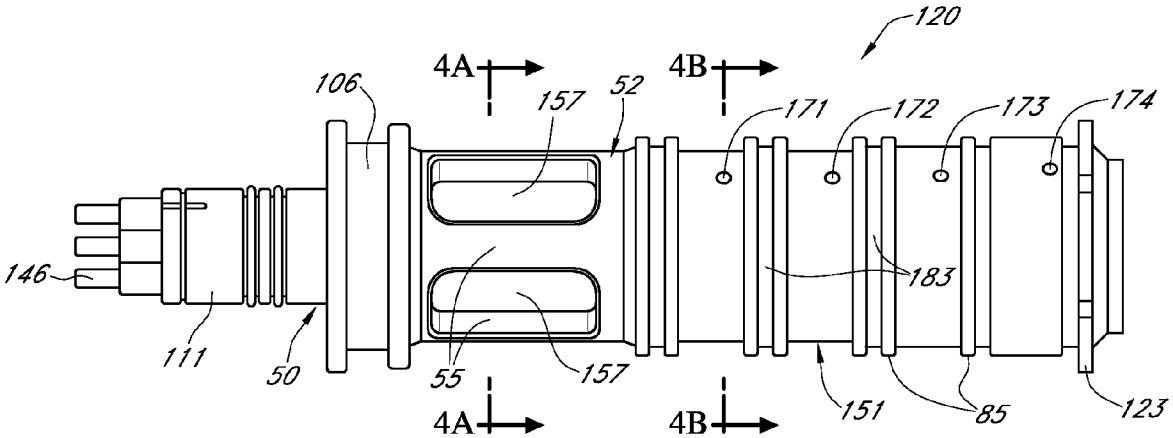
FIG. 4 is a side elevation view of the receptacle contact module of FIG. 3.
Figure 4B:
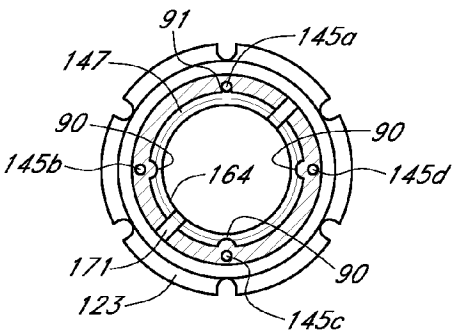
FIG. 4B is a cross section on the line 4B-4B of FIG. 4.

FIGS. 3 to 4B illustrate one embodiment of a receptacle contact module 120 designed for mating engagement with plug contact module 2, while FIG. 5 illustrates the receptacle contact module incorporated in a receptacle unit 100. Contact module 120 has a base 50 which is secured in a rear portion 101 of the receptacle shell when the receptacle unit is fully assembled, as in FIG. 5, and a generally tubular extension 52 of varying radial cross-section extending forwards from base 50. Base 50 has an enlarged flange 106 and a rearward extension 111 from flange 106 which forms the cable termination end of the module and has solder pots or cable lead connectors 146 at its rear end.

Tubular extension 52 has a wall defined by inner surface 160 and outer surface 161, and has a rear portion having a plurality of windows or openings 157 and a forward portion having a plurality of inner stepped portions 153, 154, 155, and 156 in which respective annular electrical contacts are seated, as described below. The receptacle contact module in this embodiment includes four circuits each comprising a conductor rod 145*a*, 145*b*, 145*c*, 145*d* (see FIGS. 4A and 4B) which extend from typical solder cups 146 at the cable termination end of the base 50 to respective annular contacts 147, 148, 149, 150 in the respective stepped portions 153, 154, 155, 156 of the tubular extension, as illustrated for one of the conductor rods 145*c* extending to contact 149 in FIG. 3. The conductor rods and annular contacts are over-molded with a rigid, non-electrically-conductive material forming the wall of the contact module into a monolithic unit 151. The stepped portions 153, 154, 155, 156 are of progressively increasing diameter towards the forward end of the module, with the steps having diameters that are slightly larger than corresponding steps 16, 17, 18, 19 of plug pin 15. Stepped portions 153, 154, 155, 156 house respective annular contact seats or grooves each containing a respective annular electrical contact 147, 148, 149, 150. Annular ribs 85 are provided on the outer surface of tubular portion 52 opposite each of the stepped portions, and each rib has an outer annular groove 183. An enlarged flange or shoulder 123 is provided adjacent the forward open end of module 120.

In the illustrated embodiment, the rear portion of tubular extension 52 has four elongated, generally rectangular windows or openings 157 which extend between rear flange 106 and the rearmost rib 85, as best illustrated in FIG. 4, with relatively narrow wall portions 55 extending between each adjacent pair of windows. The windows 157 of the contact module 120 permit free ventilation from the inside to the outside of the wall to the rear of the contacts. Threaded socket 158 in the bottom of bore 152 accepts and retains a centering rod 136 of the receptacle unit, as described in more detail below in connection with FIG. 5. Radial passages 171, 172, 173, 174 penetrate the wall of the tubular portion of the contact module as well as penetrating the annular grooves or contact seats in the respective stepped portions 153, 154, 155 and 156 in which contacts 147, 148, 149, 150 are seated. The radial passages permit free ventilation from the radially inward portion of the contact seats to the exterior of contact module 120. Between each pair of electrical contacts, for instance contacts 149,150, a seat or groove 165 houses a pair of elastomeric seals 166, 167 which, in the connector's mated condition, cooperate with plug pin 15 to seal the successive mating contact pairs of the plug and receptacle units from each other.

Figure 4A:
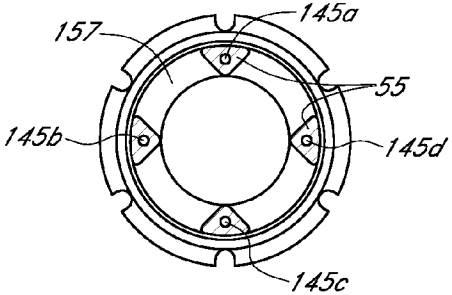
FIG. 4A is a cross section of the line 4A-4A of FIG. 4.

FIG. 4A is a side view of receptacle contact module 120. FIG. 4B is a cross-section illustrating conductor rods 145*a*, 145*b*, 145*c*, 145*d* passing through the portions 55 of over-molded dielectric material forming tubular portion 52 between window openings 157. The rods reinforce the smaller wall portions 55 separating the window openings or windows 157, and the molded dielectric material forming the wall portions electrically insulates and protects the rods. FIG. 4C illustrates one of the contact seats and the seated contact 147, illustrating radial passage 171 and attachment point 91 of contact rod 145*a* to contact band 147. Other contact rods 145*b*, 145*c*, 145*d* pass through typical clearance notches 90 of contact band 147 to other contact bands spaced along the length of contact module 120, as illustrated for contact rod 145*c* attached to contact 149 in FIG. 3.

FIG. 5 depicts connector receptacle unit 100 in a 135° axial-section. Receptacle contact module 120 is housed within a canister or shell having a rear portion 101, a reduced diameter tubular shell portion 102 extending forward from rear portion 101, and end cap 103 in a forward end opening of portion 102. Snap ring 104 seats in groove 105 of front shell 102, and retains end cap 103 in place in the forward end opening of front shell 102. Rearward extension 111 of the base 50 of contact module 102 is seated in bore 107 of the rear portion of the receptacle shell. Contact module 120 is arrested in axial position with respect to shell rear portion 101 by snap ring 108 which is captured in groove 109 of extension 111. Retainer key 110 is captured in a bore formed by groove 140 in rearward extension 111 and a corresponding groove 117 in shell rear portion 101. O-rings 118 seated in grooves 119 of rearward extension 106 seal the interface between the contact module 120 and rear shell 101. Outer bladder 125 extends from rear portion 101 to the forward open end of front shell 102 and over the receptacle contact module to define a contact chamber 190 which contains dielectric oil or a similar mobile substance, and has an integral sealing portion or outer seal at its forward end, as described in more detail below. Shoulder 116 in the posterior end of outer elastomeric bladder 125 is sealably retained in groove 121 of rear flange 106 of contact module 120.

An elastomeric, generally tubular inner bladder 180 extends within the outer bladder from rearmost annular shoulder 85 of the receptacle module 120 up to a forward end portion of the module 120 to form individual sealed contact chambers within chamber 190 when the plug and receptacle units are fully mated, as described in more detail below in connection with FIG. 6. Elastomeric inner receptacle bladder 180 is generally tubular in shape having four bulbous thin-walled sections 181 extending between heavier ribs 182. Ribs 182 are sealably stretched into respective grooves 183 formed into the ribs 85 on the exterior surface of contact module 120. The construction results in a series of small volumes 184, 185, 186, 187 (see FIG. 5) whose only ventilation is respectively through passages 171, 172, 173, 174.

Centering rod 136 extends from the rear end of the receptacle module through the tubular extension and up to the forward end of the receptacle unit 100. Center rod 136 has a large-diameter segment 189 which fits closely to the smallest diameter stepped portion 153 of bore 152, serving to keep the bore and centering rod axially aligned. Cutouts 188 on large-diameter segment 189 of rod 136 permit axial ventilation across the large-diameter section between rear and forward portions of the bore 152. The windows 157 through the tubular wall of receptacle contact module 120 to the rear of inner bladder 180 allow free ventilation from bore 152 to the volume of oil 190 contained in outer bladder 125. The windows are large enough to permit the outer bladder to flex inward into bore 152. As illustrated in FIGS. 4A and 4B, the windows or window openings are of elongated slot-like shape and extend around a major portion of the circumference of the tubular portion of the receptacle module, and along about one quarter of the overall length of the tubular portion. The extent to which a fluid-filled receptacle can compensate for volumetric changes, such as occurs when the plug pin is inserted or withdrawn, or when oil is lost during operation, depends not only on the initial volume of the oil, but also upon how much the chamber containing the oil can flex to accommodate such changes. More flex is better than less. The ability of outer bladder 125 to distort through windows 157 is therefore an important feature in extending the reliable working life of the connector.

Outer bladder 125 is ventilated to the connector's outside environment through radially-spaced passages 191 in receptacle shell 102, which lead a rear part of the shell adjacent an enlarged shoulder of rear portion 101 which has an annular end face or stop 198. Rigid cup-shaped guard 193 extends axially forward of said passages and serves to sealably retain shoulder 116 of outer bladder 125 into groove 121 of contact module 120. Guard 193 serves also to protect outer bladder 125 from damage due to foreign objects that might be introduced through passages 191.

A relatively heavy-walled segment 122 of the forward portion of outer bladder 125 is held in axial position by shoulder 123 of contact module 120 acting against shoulder 124 of end cap 103. Notches 126 in shoulder 124 against which heavy-walled outer bladder segment 122 is pressed serve both to arrest rotation of outer bladder 125, and to provide fluid passage from the interior chamber or bore of contact module 120 to the outside of contact module 120 when the plug 1 and receptacle 100 portions of the connector are mated, as seen in FIG. 6. The reason for passages created by notches 126 will be more evident later in the discussion of FIG. 6.

As best illustrated in FIG. 5, the receptacle unit has an outer annular seal formed by dual outer seals 129, 130 adjacent its forward end, which may be integrally formed with outer bladder 125. The outer annular seal is configured for mating engagement with an inner annular seal formed by dual inner seals 132, 133 on a forward portion of the centering rod in the unmated condition. In the illustrated embodiment, the outer annular seal comprises a heavy walled portion at the anterior end of bladder 125, and is defined as individual or dual outer seals or seal portions 129, 130 by groove 131. The inner annular seal comprises corresponding dual inner seals or seal portions 132, 133 secured in an annular groove or seat 135 in the forward end of center rod 136. Inner seals 132, 133 may also be molded as a single unit and defined as individual seals by a groove 134, as illustrated in FIG. 5. Although grooves 131 and 134 are V-shaped in the illustrated embodiment, they may be of other shapes such as U-shapes, rectangular shapes, or the like in alternative embodiments. Inner seals 132, 133 act in cooperation with the opposing sealing surfaces of outer seals 129, 130 as a sealing mechanism to close the chamber formed by contact module 120, outer bladder 125 and center rod 136.

In the unmated receptacle unit of FIG. 5, dual outer seals 129, 130 are held tightly against corresponding inner seals 132, 133 by embedded, radially constricting annular springs 137, 138 respectively. Seals 137, 138 are garter or coil springs in one embodiment, but any springs designed to apply a radial clamping force may be used in alternative embodiments. The seal-to-seal pressure depends more upon the inwardly directed force provided by garter springs 137, 138 than it does upon the stretch, if any, of end seals 129, 130. This is an improvement over oil-filled connector receptacles that depend solely upon elastomeric stretch to accomplish the end seal. The garter springs also render the reliability of the sealed receptacle much less vulnerable to prior-art problems of seal elastic-memory loss.

Space 139 behind the inner surface of end cap 103 is ventilated to the outside environment by an inward radial extension 140 of space 139 between the inner surface of end cap 103 and the anterior end of the forward seal 130 of the dual outer seals. The inward extension 140 is in communication with annular opening 143 formed between end cap 103 and end 144 of center rod 136. Comparing the position of dual outer seals 129, 130 in the unmated receptacle section of FIG. 5 to the comparable section of the mated receptacle in FIG. 6, it is seen that seals 129, 130 move radially outward into space 139 during mating to sealably accommodate plug pin 15. Environmental material (water, in the case of underwater operation) displaced by the outward radial movement of dual outer seals 129, 130 is ventilated through radial extension 140 of space 139 and annular opening 143.

Figure 6:
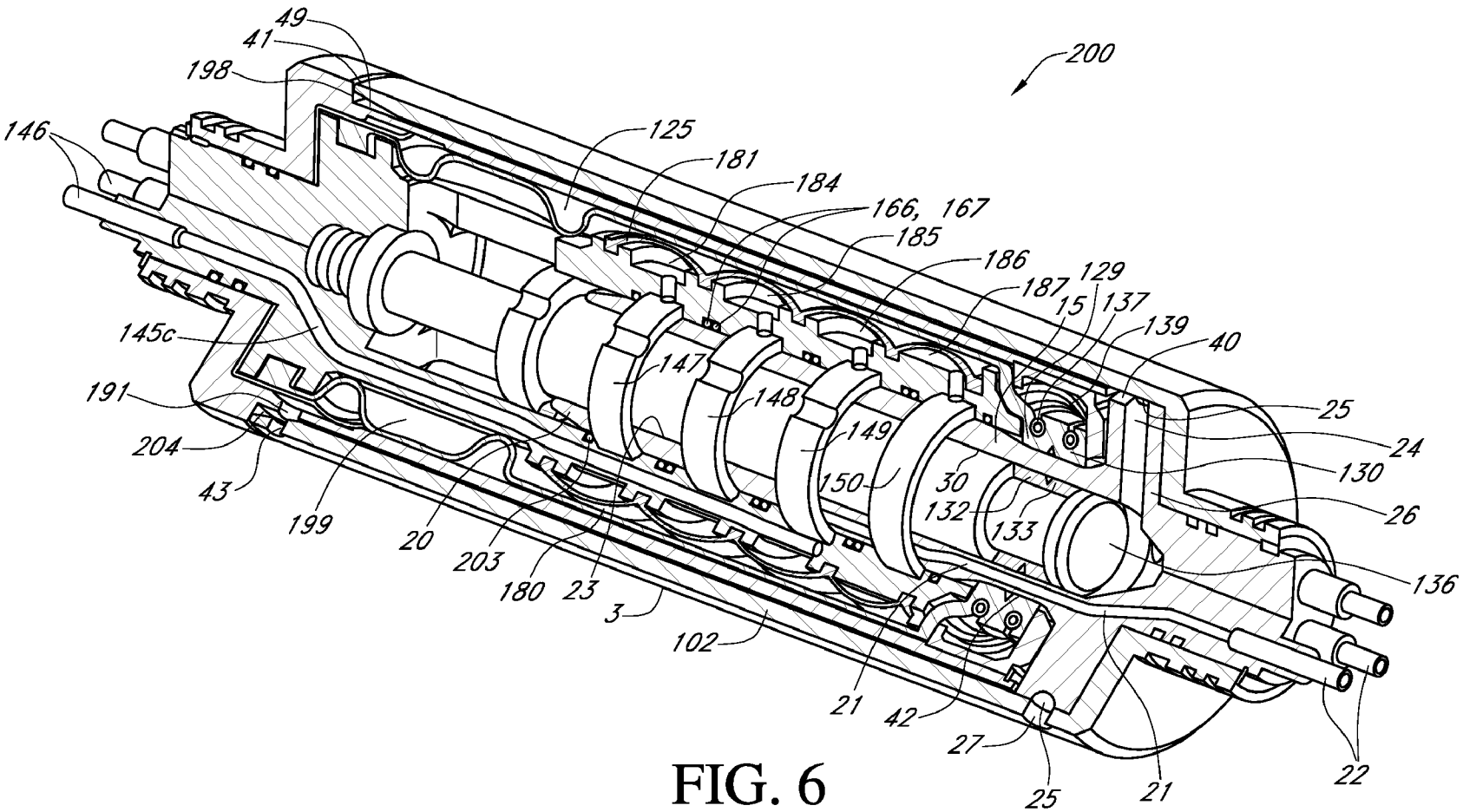
FIG. 6 is a 135 degree axial, partial cross-sectional view of the mated plug and receptacle units of FIGS. 2 to 5.

FIG. 6 illustrates a partial, 135° axial-section through the mated plug and receptacle units of connector 200. One electrical circuit through the connector remains un-sectioned for clarity, specifically the circuit from one of the receptacle solder pots 146, conductor rod 145*c*, annular inner contact 149 of the receptacle module, annular outer contact 13 of the plug pin, conductor rod 21 extending from contact 13 through pin 15 to the rear end of the plug unit, and the plug solder pot 22 to which the illustrated conductor rod 21 is connected. The other three communication circuits are formed in the same way when the plug and receptacle units are fully mated. As the mating sequence begins, receptacle unit 100 enters the open end of plug shell 3, with the shell acting to provide axial alignment of the mating parts.

As mating proceeds, tapered end 20 of plug pin 15 enters annular opening 143 in the mating face of the receptacle, eventually pressing against the interface between the forward seal portions 130, 133 of the receptacle dual outer and inner seals. Continued engagement of the mating halves causes tapered end 20 to pass sealably into and through the interface, while the inner and outer seals wipe the inside 30 and outside 31 surfaces of plug pin 15 clean as the pin passes through them. The rear seal portions 129 and 132 of the dual outer and inner seals provide a second wiping and sealing of the pin surfaces as the pin passes between the seals and into the annular space between the receptacle module and centering rod 136.

Receptacle centering rod 136 cooperates with plug shell 3 and receptacle shell portion 102 to further axially align the mating components. As receptacle centering rod 136 sealably enters bore 23 of plug pin 3, it forces environmental material, e.g. water in the case of underwater mating, out through passages 24 in base flange 26 of plug contact module 15, the material entering circumferential groove 25 in the flange, and eventually exiting through vent holes 27 in plug shell 3. Furthermore, as receptacle unit 100 enters plug shell 3, environmental material, e.g. water in the case of underwater mating, escapes through notches 40 in flange 26 that communicate with circumferential groove 25 in the flange, and eventually exits through vent holes 27 in plug shell 3. The mating sequence continues until forward end 41 of plug shell 3 butts against end face 198 of the shoulder at the rear portion 101 of the receptacle shell. Comparing the receptacle end seal areas in FIGS. 5 and 6 shows the radially outward movement of dual outer seals or seal portions 129, 130 to accommodate plug pin 3. The dual outer seals 129, 130 sealably conform to the smaller diameter rear portion 42 of the plug pin when the connector portions are fully mated. It was stated earlier that the stretch on elastomers should not exceed about 25% for extended periods of time, particularly in conditions typical of cold, deep water; otherwise, the elastomers could lose their elastic "memories" and fail to return to their original size when the agent stretching them is removed. The reduced-diameter rear portion 42 of plug pin 3 minimizes stretch in the mated condition, while allowing increased stretch temporarily during the mating/de-mating operation.

As the plug pin 3 moves further into the bore in the receptacle module and over contact rod 136 until it reaches the fully mated condition of FIG. 6, each outer annular contact 11, 12, 13, 14 engages the corresponding inner annular contact 147, 148, 149, 150, respectively. Comparing the rear portion 199 of outer receptacle bladder 125 in FIGS. 5 and 6, it is seen that portion 199 balloons outward when the plug and receptacle units are fully mated, due to the amount of oil 190 displaced by incoming plug pin 3.

A study of FIG. 6 reveals that each plug/receptacle set or pair of engaged contacts is separated from each other set by at least two elastomeric barriers, and furthermore that each set is separated from the external environment by at least two elastomeric barriers. Each contact set is enclosed in its own sealed oil volume 184, 185, 186, 187 defined by the bulbous elastomeric wall segments 181 of inner receptacle bladder 180, and by seals such as 166, 167 and 203 which seal to plug pin 3. These individual sealed volumes are closed off as plug pin 3 nears the fully-mated position. Therefore, they need only to compensate the oil volume contained within them for environmental variations such as temperature and pressure.

Once the connector is fully mated, further ventilation to the exterior environment occurs through vents 191 in receptacle shell 102 communicating with gap 204 formed between receptacle shell portion 102 and the taper 49 in the open end of plug shell 3, and further communicating between gap 204 and the exterior environment through vents 43 in the tapered forward end of plug shell 3.

It should be noted that the construction just described results in a connector with relatively few parts compared to traditional spring-and-stopper constructions. Furthermore, as there are no axial opposing spring forces to overcome, the mating insertion force is relatively much smaller, and there is no spring force to overcome to keep the connector in the mated condition.

The connector described above solves many of the inadequacies of presently available harsh-environment connectors, both keyless and otherwise. In particular, it requires no rotational keying; it helps to avoid cross-connection during mating and de-mating; it removes the need for springs and stoppers; and, it results in an extremely simplified, compact product that should be relatively inexpensive. Although the connector described above has four sets of mating annular inner and outer contacts, connectors in alternative embodiments may have a lesser or a greater number of mating electrical contacts.

A connector with stepped contacts that has a hollow plug pin as described above opens the door to many flexible design advantages. The above connector uses garter springs to close an outer seal against an inner seal. The connector receptacle has a hollow core with windows that allow inward distortion of the oil-volume-compensating flexible wall or bladder. Another advantage of the connector in the above design is the smaller-diameter, pin portion 42 that resides in the receptacle seals when the connector is mated, reducing stretching of the seals.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

I claim:

1. A harsh environment connector, comprising:

a plug unit containing a contact pin having a forward end, a rear end, and an outer surface having a plurality of stepped portions of increasing diameter towards the rear end of the pin, each stepped portion including a respective annular electrical contact;

a receptacle unit defining at least one contact chamber, a tubular receptacle contact module in said contact chamber having a rear end, an open forward end configured to receive the plug contact pin and an inner surface having a plurality of stepped portions of decreasing diameter towards the rear end of the contact module which are of diameters configured for mating engagement with corresponding stepped portions of the pin, whereby the pin is a close sliding fit in said contact module, each stepped portion having a contact seat and a respective annular electrical contact secured in said seat;

the plug and receptacle units being movable between an unmated condition and a mated condition in which they are in releasable mating engagement with the contact pin in mating engagement in the contact module and each electrical contact on the contact pin in electrical communication with a corresponding electrical contact in the receptacle contact module to form a respective mated contact pair;

the receptacle unit having an opening communicating with the contact chamber which receives the plug pin as the units are moved into mating engagement; and a seal assembly in the opening which is configured to seal the contact chamber in the unmated condition of the units and to form a seal against at least the outer surface of the plug pin in the mated condition of the units.

2. The connector of claim 1, wherein the plug contact pin is hollow and has an open forward end.

3. The connector of claim 2, further comprising a centering rod in the receptacle unit extending through the receptacle contact module and having a forward portion located in the opening of the receptacle unit, the seal assembly comprising at least an annular outer seal in the opening configured for sealing engagement with the forward portion of the centering rod in the unmated condition of the units.

4. The connector of claim 3, wherein the centering rod is configured for mating engagement in the hollow plug pin in the mated condition of the units.

5. The connector of claim 4, wherein the seal assembly further comprises an annular inner seal on the forward portion of the rod which is configured for sealing engagement with the outer seal in the unmated condition of the units and for sealing engagement with an opposing inner surface portion of the plug pin in the mated condition of the units, whereby the plug pin is sealed between the outer seal and inner seal.

6. The connector of claim 5, wherein the outer seal has an inwardly directed groove dividing the outer seal into dual outer seal portions, and the inner seal has an outwardly directed groove aligned with the inwardly directed groove and dividing the inner seal into corresponding dual inner seal portions.

7. The connector of claim 6, further comprising a pair of annular, radially constricting springs embedded in the outer seal portions and configured to apply a radial clamping force to urge the outer seal portions into sealing engagement with the inner seal portions.

8. The connector of claim 7, wherein the springs are garter springs.

9. The connector of claim 1, wherein the seal assembly comprises at least an annular outer seal in the receptacle opening and at least one annular, radially constricting spring embedded in the outer annular seal and configured to apply a radially inwardly directed clamping force.

10. The connector of claim 9, wherein the spring is a garter spring.

11. The connector of claim 9, wherein the outer seal has a central, inwardly directed groove dividing the seal member into dual seal portions, and at least one annular, radially constricting spring is embedded in each seal portion.

12. The connector of claim 1, further comprising an outer generally tubular, elastomeric bladder in the receptacle unit forming said contact chamber and extending over the receptacle module to the opening in the receptacle unit.

13. The connector of claim 12, wherein the seal assembly comprises at least an outer seal comprising an integrally formed forward end portion of the bladder.

14. The connector of claim 12, wherein the receptacle contact module has a rear end portion spaced to the rear of the contact portions having openings for communication between portions of the contact chamber outside the contact module and the inside the contact module.

15. The connector of claim 14, wherein the openings are configured to allow portions of the outer bladder to flex inwardly through the openings for pressure compensation during insertion and withdrawal of the plug pin.

16. The connector of claim 15, wherein the openings comprise a series of elongate windows spaced around the outer surface of the rear portion of the receptacle contact module, the openings having a length greater than the distance between adjacent electrical contacts.

17. The connector of claim 16, wherein the combined width of the windows comprises a major portion of the circumference of the rear portion of the receptacle contact module.

18. The connector of claim 12, further comprising an inner tubular bladder in the contact chamber which surrounds at least part of the length of the receptacle contact module, the tubular bladder having a series of inwardly extending ribs engaging the outer surface of the contact module at spaced intervals and bladder portions between adjacent ribs, the bladder portions between adjacent ribs defining separate internal chambers, each chamber extending over a respective stepped portion of the receptacle contact module containing a contact in respective contact seat, and each stepped portion of the receptacle contact module having at least one through bore from the outside to the inside of the contact module.

19. The connector of claim 1, further comprising a series of spaced annular inner seals on the inner surface of the receptacle contact module configured for sealing engagement with an opposing surface portion of the pin when the units are in the mated condition, the inner seals comprising at least a rear end seal located to the rear of the contacts and intermediate seals between each adjacent pair of contacts on the inner surface of the receptacle contact module, wherein each mated opposing pair of electrical contacts in the mated condition of the units is isolated from the remaining contact pairs.

20. The connector of claim 19, wherein each intermediate seal comprises dual seal members.

21. The connector of claim 1, wherein the diameter difference between successive contact portions of the plug pin is no less than approximately 0.05 inches.

22. The connector of claim 1, wherein there are at least three stepped contacts on the plug pin and a corresponding number of contacts in the receptacle module.

23. The connector of claim 1, wherein the plug pin has a tapered tip extending to the forward end of the pin.

24. The connector of claim 1, wherein the rear end of the plug pin has a cable termination comprising a plurality of cable lead connectors, and a respective conductor extends through the hollow plug pin from each cable lead connector to a respective electrical contact to provide electrical communication from a connected cable to the electrical contacts.

25. The connector of claim 24, wherein the plug pin is integrally molded around the respective electrical contacts, and at least some of the electrical contacts have an inner surface including at least one notch for clearance between a respective contact and conductors extending to adjacent electrical contacts.

26. The connector of claim 1, wherein the contact chamber is filled with a mobile substance.

27. A plug unit for releasable mating engagement with a receptacle unit of a harsh environment connector, the plug unit comprising:

an outer shell having a rear end and an open forward end;

a hollow contact pin in the outer shell extending forward from the rear end of the shell and having an open forward end, an outer surface, and an inner surface, the contact pin being configured for engagement in a mating receptacle unit; and the contact pin having at least two outer stepped contact portions of increasing diameter towards the rear end of the shell, each contact portion including a respective annular electrical contact.

28. The plug unit of claim 27, wherein the diameter difference between successive contact portions of the plug pin is no less than approximately 0.05 inches.

29. The plug unit of claim 27, wherein the plug pin has at least three stepped contact portions.

30. The plug unit of claim 27, wherein the plug pin has a tapered tip extending to the forward end of the pin.

31. The plug unit of claim 27, wherein a rear contact portion of the pin of maximum diameter is spaced from a rear end of the pin, and the pin has a reduced diameter portion to the rear of said rear contact portion configured for engagement with an outer seal in a forward end opening of a mating receptacle unit when the units are mated.

32. The plug unit of claim 27, wherein the plug pin has a rear end having a cable termination comprising a plurality of cable lead connectors configured for connection to respective leads of a cable, and a respective conductor extends through the hollow plug pin from each cable lead connector to a respective electrical contact to provide electrical communication from a connected cable to the electrical contacts.

33. The plug unit of claim 32, wherein the plug pin is integrally molded around the respective electrical contacts and conductors, and at least some of the electrical contacts have an inner surface including at least one notch for clearance between a respective contact and conductors extending to adjacent electrical contacts.

34. A receptacle unit for releasable mating engagement with a plug unit of a harsh environment connector, the receptacle unit comprising:

an outer shell having a rear end and a forward end and having at least one contact chamber having a forward opening;

a tubular receptacle contact module in said contact chamber, the module having an open forward end and being configured for receiving a plug pin of a mating plug unit, the module having a tubular wall with a rear portion having a plurality of windows communicating between the outside and inside of the tubular contact module and a forward portion having at least one annular, inwardly facing electrical contact;

an annular outer seal in the forward opening of the contact chamber for sealing engagement with a rear portion of a plug pin when the receptacle unit is in mating engagement with a corresponding plug unit;

a pressure compensating flexible bladder extending around the contact module up to the annular outer seal to surround the contact chamber; and the bladder and the windows being configured to allow portions of the bladder to flex inwardly through the windows for pressure compensation during insertion and withdrawal of the plug pin.

35. The receptacle unit of claim 34, wherein the windows comprise a series of elongate openings spaced around the outer surface of the rear portion of the receptacle contact module and extending axially up to the forward portion of the receptacle contact module.

36. The receptacle unit of claim 35, wherein the windows extend along at least one quarter of the length of the receptacle contact module.

37. The receptacle unit of claim 36, wherein the windows extend around a major portion of the circumference of the rear portion of the receptacle contact module.

38. The receptacle unit of claim 35, wherein the forward portion has at least two spaced annular electrical contacts on the inner surface of the receptacle contact module positioned for electrical communication with a corresponding outer contacts on the plug pin when the receptacle unit is mated with a corresponding plug unit, and at least two conductors extending from the rear end of the receptacle unit through the wall of the receptacle contact module to respective annular electrical contacts on the inner surface of the module.

39. The receptacle unit of claim 34, wherein the inner surface of the forward portion has a plurality of stepped portions of increasing diameter towards the forward end of the receptacle contact module which are of diameters configured for mating engagement with corresponding stepped portions of a plug pin, each stepped portion including a respective annular electrical contact.

40. The receptacle unit of claim 39, wherein the rear portion of the contact module has respective wall portions between adjacent windows, and a plurality of conductors extending from the rear end of the contact module, each conductor being connected to a respective electrical contact and extending through a respective one of said wall portions such that only one conductor extends through each wall portion.

41. The receptacle unit of claim 38, wherein the forward portion of the receptacle contact module has a series of spaced radial passageways, each radial passageway extending through the wall of a respective stepped portion of the contact module for communication between the outside and inside of the contact module.

42. The receptacle unit of claim 41, further comprising an inner tubular bladder in the contact chamber which surrounds at least the forward portion of the receptacle contact module, the tubular bladder having spaced connecting portions secured to the outer surface of the contact module and respective bladder portions extending between each pair of connecting portions, the bladder portions surrounding respective successive contacts and each forming a sealed volume surrounding a respective contact when the receptacle unit is mated with a mating plug unit.

43. The receptacle unit of claim 42, further comprising a plurality of spaced inner seals on the inner surface of the contact portion configured for sealing engagement with a plug pin when the receptacle unit is in mating engagement with a corresponding plug unit, the inner seals comprising a rear seal between the rear portion and forward portion of the plug module and an intermediate seal between each pair of adjacent contacts.

44. The receptacle unit of claim 43, wherein each intermediate seal comprises dual seal members.

45. The receptacle unit of claim 34, further comprising a fixed centering rod in the receptacle unit extending through the receptacle contact module and configured to engage in a bore in hollow plug pin when the receptacle unit is in mating engagement with a corresponding plug unit.

46. The receptacle unit of claim 45, wherein the centering rod has a forward portion located in the forward end of the receptacle unit, the forward portion being configured for sealing engagement with the annular outer seal in the unmated condition of the units.

47. The receptacle unit of claim 46, wherein the forward portion of the centering rod includes an annular inner seal which is configured for sealing engagement with the annular outer seal.

48. The receptacle unit of claim 47, including at least one radially constrictive spring embedded in the annular outer seal and configured to close the annular outer seal around the inner seal on the centering rod.

49. The receptacle unit of claim 48, wherein the spring comprises a garter spring.

50. The receptacle unit of claim 47, wherein the outer and inner seals each comprise dual seal portions.

51. A harsh environment connector, comprising:

a plug unit having a contact pin and at least one annular electrical contact on the outer surface of the contact pin;

a receptacle unit having at least one contact chamber, a receptacle contact module in said contact chamber having an open forward end configured to receive the plug contact pin and an inner surface having at least one electrical contact;

the plug and receptacle units being movable between an unmated condition and a mated condition in which they are in releasable mating engagement with the contact pin in mating engagement in the contact module and the electrical contact on the contact pin in electrical communication with the corresponding electrical contact in the contact module;

the receptacle unit having an opening which receives the plug pin;

opposing inner and outer seals in the opening which are configured for sealing engagement in the unmated condition of the units, at least the outer seal being configured for sealing engagement with the plug pin in the mated condition of the units; and at least one radially constrictive spring embedded in the outer seal and configured to close the outer seal against the inner seal in the unmated condition of the units and against the plug pin in the mated condition of the units.

52. The connector of claim 51, wherein the radially constrictive spring comprises a garter spring.

53. The connector of claim 51, wherein the outer seal has dual seal portions, a first radially constrictive spring embedded in one of the seal portions and a second radially constrictive spring embedded in the other seal portion.

54. The connector of claim 53, wherein the first and second springs comprise garter springs.

55. The connector of claim 53, wherein the inner seal comprises dual seal portions opposing the respective seal portions of the forward end seal.

56. The connector of claim 51, further comprising a fixed centering rod in the receptacle unit which extends through the receptacle module up to the opening, the inner seal being located on the centering rod, wherein the plug pin comprises a hollow pin having a bore which is open at the forward end of the pin, the rod is configured for mating engagement in the pin bore when the units are moved into the mated condition, and the inner and outer seal are configured for mating engagement with opposing inner and outer portions of the hollow plug pin in the mated condition of the units.

* * * * *